US009044853B2

(12) United States Patent
Phui

(10) Patent No.: US 9,044,853 B2
(45) Date of Patent: Jun. 2, 2015

(54) HANDGRIP FOR A DENTAL DEVICE

(71) Applicant: Jennie S. Phui, Anaheim, CA (US)

(72) Inventor: Jennie S. Phui, Anaheim, CA (US)

( * ) Notice: Subject to any disclaimer, the term of this patent is extended or adjusted under 35 U.S.C. 154(b) by 254 days.

(21) Appl. No.: 13/799,738

(22) Filed: Mar. 13, 2013

(65) Prior Publication Data

US 2014/0260838 A1 Sep. 18, 2014

(51) Int. Cl.
*B25G 3/04* (2006.01)
*B25G 1/10* (2006.01)
*B25G 3/12* (2006.01)

(52) U.S. Cl.
CPC *B25G 1/102* (2013.01); *B25G 3/12* (2013.01); *Y10T 29/49826* (2015.01)

(58) Field of Classification Search
CPC ..... B25G 1/00; B25G 1/10; B25G 1/102; B25G 1/051; B25G 3/04; B25G 3/10; B25G 3/12; B25G 3/14; A46B 5/02; A46B 5/025
USPC ..... 81/489, 177.2; 16/441
See application file for complete search history.

(56) References Cited

U.S. PATENT DOCUMENTS

| | | | | |
|---|---|---|---|---|
| 940,744 | A | 11/1909 | Smith | |
| 1,386,756 | A | 8/1921 | Benson et al. | |
| 4,386,448 | A * | 6/1983 | Kohn | 16/441 |
| 4,523,781 | A | 6/1985 | Brody | |
| 4,602,885 | A | 7/1986 | Bischoff et al. | |
| 4,606,484 | A | 8/1986 | Winter et al. | |
| 5,597,189 | A | 1/1997 | Barbee, Sr. | |
| 5,722,575 | A | 3/1998 | Smith | |
| 5,791,705 | A | 8/1998 | Romero et al. | |
| D527,527 | S * | 9/2006 | Ramelli | D4/107 |
| 7,438,726 | B2 * | 10/2008 | Erb | 623/57 |
| 7,549,686 | B2 * | 6/2009 | Watanabe | 294/25 |
| 8,307,742 | B2 * | 11/2012 | Hsu | 81/177.2 |
| 2009/0144921 | A1 | 6/2009 | Newsome | |

FOREIGN PATENT DOCUMENTS

| | | | |
|---|---|---|---|
| CN | 201431102 | Y | 3/2010 |
| JP | 10014659 | A | 1/1998 |

* cited by examiner

*Primary Examiner* — Hadi Shakeri
(74) *Attorney, Agent, or Firm* — Knobbe Martens Olson & Bear, LLP

(57) ABSTRACT

Embodiments are directed to a dental device holder for holding a dental device in place and a method of use of the dental device holder for providing dental care. The dental device holder can include a spherical outer wall with a plurality of holes in the wall, wherein a dental instrument can be inserted through the holes and frictionally retained in the dental device holder. The dental device holder can include attachment elements. A strap can be attached to the dental device holder using the attachment elements.

20 Claims, 8 Drawing Sheets

HANDGRIP FOR A DENTAL DEVICE

BACKGROUND

1. Field

Embodiments of the present invention relate to a handgrip for a dental device and a method of use for a handgrip for a dental device, suitable for use by elderly or special needs persons.

2. Description of the Related Art

People of advanced age or people having special needs may not be able to provide adequate dental care for themselves. For example, such individuals may lack the requisite mobility, strength, control and/or dexterity of their hands and arms. Brushing teeth and other dental care requires both grip strength and relatively fine motor skills. A person should be able to maneuver a device, such as a brush or floss, around all of his or her teeth, as well as between the teeth. Such movements require such motor skills. In addition, certain individuals, including people of advanced age and those with special needs, may lack the necessary strength to securely hold onto the thin, small diameter dental equipment typically used by individuals in maintaining proper oral hygiene. Such individuals may also lack the necessary dexterity to manipulate dental hygiene devices to the appropriate position in order to adequately clean their teeth and gums.

The inability for a person to provide themselves with adequate dental care may come with many difficulties. First of all, the lack of adequate dental care could cause health problems, especially involving the teeth and gums. Gingivitis, gum disease, and tooth decay may all result from inadequate dental care. Second, the inability of an individual to provide adequate dental care for him- or herself may require the person to seek assistance from a nurse or caregiver to perform basic oral hygiene procedures, which can lead to feelings of inadequacy or depression.

Proper dental care is important to maintain a healthy lifestyle. Improper dental care can lead to plaque buildup on the surface of the teeth. Plaque is a film of bacteria that covers teeth and leads to tooth decay, gum recession, and bone loss. The bacteria begin to break down the enamel on the outside of the teeth and create holes, known as cavities. Plaque is also responsible for gingivitis, a disease where the gums become swollen, red, sore, and bleed. Gingivitis can lead to periodontal disease, which can result in the gums receding and pulling back from the teeth. When gums recede, the tooth roots can become exposed. The roots of teeth are very porous, unlike the crown of the tooth, which is covered in a layer of enamel. The porosity allows air and fluids to enter the roots and stimulate the nerves found within the teeth. This can cause sensitivity and pain to the individual. Periodontal disease can lead to loose teeth, which can fall out of the individual's mouth. Periodontal disease has even been shown to increase the risk of heart attack and stroke. Inadequate dental care can cause bad breath. Proper oral hygiene, including brushing and flossing, can prevent many of these dental care issues.

Certain individuals, including the elderly, persons may also suffer from arthritis. Arthritis is one of the most common disabilities in the United States, affecting more than 20 million individuals. A variety of arthritic conditions can occur, including osteoarthritis and rheumatoid arthritis. Arthritis occurs due to inflammation of joints and can lead to constant joint pain and possible muscle strains caused by forced movements of the swollen joints. Arthritis can significantly limit an individual's ability to provide proper orl hygiene to him- or herself due to the difficulty in controlling and manipulating common oral hygiene devices, including a toothbrush.

SUMMARY

In one embodiment, dental device holder configured to adjustably retain a dental device in a user's hand includes: a substantially spherical outer wall having a substantially uniform outer wall thickness; the wall defining a substantially spherical interior volume; the wall having a plurality of substantially circular opening pairs diametrically opposed to each other and positioned at substantially opposite regions of the interior volume, each opening having a diameter of less than about 2 cm; wherein each opening is sized to receive at least a portion of a dental device having an elongate shaft longer than a diameter of the outer wall, such that the elongate shaft enters the outer wall through a first opening of an opening pair and traverses the interior volume and exits the outer wall through a second opening of the opening pair; and wherein each opening pair is configured to frictionally retain the dental device within the wall during use.

In another embodiment, a dental device holder configured to adjustably retain a dental device in a user's hand includes: an outer wall having a substantially uniform outer wall thickness; the wall defining an interior volume; the wall having a plurality of openings distributed about the outer wall; wherein each opening is sized to receive at least a portion of a dental device having an elongate shaft, such that the elongate shaft enters the outer wall through a first opening of an opening part and traverses the interior volume and exits the outer wall through a second opening; and wherein each opening is further configured to frictionally retain the dental device within the wall during use.

The dental device holder may also include an attachment element coupled to the outer wall. The attachment element may include a prong. The attachment element may be integrally formed with the outer wall. The attachment element may be located inside the plurality of openings. The attachment element may include a slot located on the outer wall, the slot and the wall together defining an attachment portion. The slot may extend from one opening to an adjacent opening.

The dental device holder may also include a strap configured to attach to the attachment element. The dental device holder may also include a strap configured to attach to the dental device. The outer wall may include a compressible material configured to apply even, non-damaging pressure against teeth and gums during use. The dental device holder may include smooth surfaces. The dental device may be configured to allow adjustability of an orientation of the dental device within the dental device holder without moving or manipulating the dental device holder. The openings may be configured to allow for rotation of the dental device in the dental device holder. The openings may be configured to allow for translation of the dental device with respect to the dental device holder, wherein the elongate shaft remains within the outer wall during translation. The outer wall may include a single piece. The plurality of openings may include a plurality of hole sizes.

One embodiment of a method of manufacturing the dental device holder includes: providing a first half of the outer wall; providing a second half of the outer wall; and attaching the first half and the second half together to define the interior volume. The attaching may be selected from the group consisting of welding, gluing and screwing.

In another embodiment, a method of providing dental care includes: providing a dental device holder, the dental device holder comprising: a substantially spherical outer wall having a substantially uniform outer wall thickness; the wall defining a substantially spherical interior volume; the wall having a plurality of substantially circular opening pairs diametrically opposed to each other and positioned at substantially opposite regions of the interior volume, each opening having a diameter of less than about 2 cm; wherein each opening is sized to receive at least a portion of a dental device having an elongate shaft longer than a diameter of the outer wall, such that the elongate shaft enters the outer wall through a first opening of an opening pair and traverses the interior volume and exits the outer wall through a second opening of the opening pair; and wherein each opening pair is configured to frictionally retain the dental device within the wall during use; securing the dental device holder to a user's hand; inserting the dental device through an opening pair of the dental device holder, such that the dental device extends through the dental device holder; wherein the dental device holder is configured to allow a user to rotate the dental device holder and dental device without substantially moving the user's hand.

DETAILED DESCRIPTION

Figure 1:
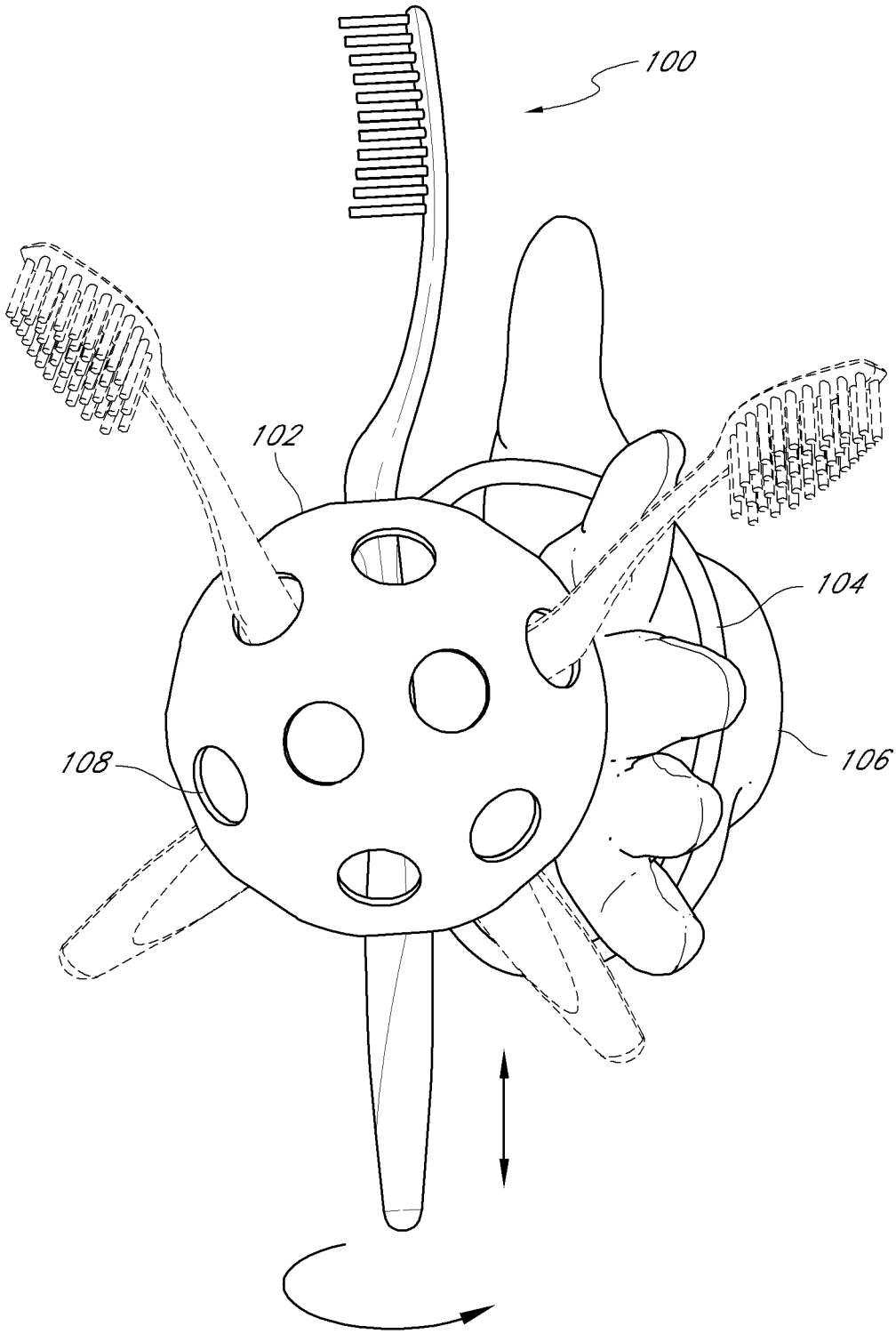
FIG. 1 illustrates one embodiment of a dental device handgrip configured to receive and retain a dental instrument.

Disclosed herein are handgrips, as well as methods of use of handgrips, for use by elderly or special needs persons to provide proper dental care.

Any term not directly defined herein shall be understood to have all of the meanings commonly associated with such term, as understood within the art. Certain terms are discussed below, or elsewhere in the specification, to provide additional guidance to the practitioner in describing the compositions, methods, systems, and the like of various embodiments, and how to make or use them. It will be appreciated that the same thing may be said in more than one way. Consequently, alternative language and synonyms may be used for any one or more of the terms discussed herein. No significance is to be placed upon whether or not a term is elaborated or discussed herein. Some synonyms or substitutable methods, materials and the like are provided. Recital of one or a few synonyms or equivalents does not exclude use of other synonyms or equivalents, unless it is explicitly stated. Use of examples in the specification, including examples of terms, is for illustrative purposes only and does not limit the scope and meaning of the embodiments herein.

The devices and methods of this disclosure each have several aspects, no single one of which is solely responsible for its desirable attributes. Without limiting the scope of this invention, its more prominent features will now be discussed briefly.

In some embodiments, a handgrip is sized in diameter for proper gripping within a user's hand. The handgrip can be large enough to be adequately grasped in a human hand without the thumbs and fingers being able to touch each other around the diameter of the handgrip. The handgrip can fit comfortably in one hand and does not require the use of two hands. The handgrip can be manufactured in many different sizes to fit different sized and shaped hands, and is not limited by size. The handgrip can be able to fit into the hands of a person of any age. The comfortable size of the handgrip provides an easier grip if a person has weakened strength. Therefore, the person may be able to squeeze onto the handgrip more easily than they could a small, thin dental device, which would require greater dexterity and control.

To enhance the ability for a person to be able to keep the handgrip within the palm of their hand, a strap element can be attached to the device. The strap element includes, but is not limited to, a band, a leash, a tie, or a supporting band. The strap element allows for a person having little or no grip strength to be able to use the handgrip. Some individuals, including the elderly and special needs persons, lack the ability to grip onto an object with their hand. However, with a strap element attached to the handgrip, the handgrip can be attached directly to the hand of a person, thereby allowing a person with limited grip strength to be able to provide themselves with adequate dental care. Multiple types of strap elements can be used to attach the handgrip onto a person's hand. In some embodiments, the strap element can be physically attached onto the handgrip. In other embodiments of the handgrip, the strap element can be attached to one of the dental devices supported by and protruding from the handgrip. In some embodiments, a strap is not provided.

A gel coating can cover at least the outer surface of the handgrip to increase friction/stickiness of the handgrip, thus allowing a person to more easily hold onto the handgrip. In some embodiments, an elastic coating can cover at least the outer surface to again increase the ease of gripping the handgrip. In some embodiments, the handgrip can contain small bumps on its surface to allow for easier grip by the patient. In some embodiments, the handgrip is sufficiently compressible to allow for a person to be able to slightly squeeze compress the handgrip. This would allow for a person to more easily hold onto the handgrip. Additionally, the handgrip can formed from a compressible material configured to apply even, non-damaging pressure against teeth and gums during use. This can alleviate some of the issues of a person applying too much pressure, thus damaging teeth and gums, or too little pressure, thus not providing adequate dental care.

Certain embodiments of the handgrip can be useful in holding different types of dental devices. For example, the handgrip can contain dental devices such as, but not limited to, toothbrushes for brushing teeth, rubber-tipped dental picks for cleaning between teeth and between the teeth and gums to remove plaque or other build-ups that a toothbrush may or may not be able to remove, and flossing devices to floss in between teeth and remove items embedded in the gums. Other types of dental devices can also be inserted into the handgrip.

In other embodiments, the handgrip is formed as one single unit. The handgrip can be assembled by methods such as, but not limited to, gluing two halves of the handgrip together, welding two halves of the handgrip together, ultrasonic welding two halves of the handgrip together, melting two halves of the handgrip together, or screwing two halves of the handgrip together. The handgrip could also be molded as one piece so there is no need to assemble two sides together. By having only one solid piece upon assembly, the handgrip contains no requirements of clasps, hooks or other means that would be difficult for an elderly or special needs person having limited mobility or dexterity in their hands to operate or set up. Additionally, the handgrip can comprise smooth surfaces, thereby preventing a user from potentially injuring themselves while using the handgrip. As mentioned above, handgrips can have clasps or hooks. These could be caught on a person's hand during use or adjustment of the handgrip.

In certain embodiments of the handgrip, the handgrip contains no small spaces that could potentially trap dirt or other debris. The handgrip is simple to clean for an elderly or special needs person with weakened hand dexterity. For at least these reasons, the handgrip is hygienic, easily cleanable, and washable.

In certain embodiments, the handgrip is made of materials that are safe for use in a dishwasher. These materials include, but are not limited to, plastics, acrylics, and polycarbonates. The materials can also be chosen to resist scratching, denting, or other physical damage. The dishwasher can put high heat stresses onto objects placed inside; therefore, in some embodiments the handgrip is made of materials that would withstand the high temperatures of a dishwasher. Dishwasher-safe material allows for easy cleaning, especially for elderly and special needs persons, who may lack the ability to manually clean the handgrip on their own.

The handgrip may be used by dental care practitioners to teach proper dental hygiene techniques. The dental care practitioner can use the handgrip to demonstrate its proper use. The handgrip could be packaged with an assortment of dental care devices to help elderly and special needs persons maintain adequate dental care. In some embodiments, the handgrip does not require specialized dental equipment that is sized to fit within its openings. The handgrip does not require modification of standard dental instruments bought from stores, such as toothbrushes, rubber tip cleaners, proxy brushes, dental floss holders, etc.

Handgrip for a Dental Device

FIG. 1 illustrates one embodiment of a handgrip having several openings or holes and a strap. The openings in the handgrip define passages through which a dental device may be inserted and retains. "Holes" is a broad term and is to be given its ordinary and customary meaning to a person of ordinary skill in the art (that is, it is not to be limited to a special or customized meaning) and includes, without limitation, circular cuts through the body of the handgrip or openings. Strap element is a broad term and is to be given its ordinary and customary meaning to a person of ordinary skill in the art (that is, it is not to be limited to a special or customized meaning) and includes, without limitation, a supporting band.

The handgrip 100 includes a body element 102 and a strap element 104, which is attached to the body element 102. In FIG. 1, the body element 102 has a substantially spherical shape. In some embodiments, the body element 102 can form a substantially spherical interior volume. In other embodiments, the body element is formed in other shapes, such as, but not limited to, an egg shape, a cylinder shape, or a cube shape, having an interior volume of substantially the same size. The body element 102 is configured to fit comfortably in a user's hand. The body element 102 can have a substantially uniform wall thickness.

The strap element 104 can be positioned around a hand 106 of a user to secure the handgrip to the hand, therefore requiring limited to no grip strength in order to use the handgrip. The strap element 104 can be wrapped completely around a hand 106, as shown in FIG. 1. However, the strap element 104 can also be formed to wrap around certain fingers, or the strap element 104 can contain loops to insert a hand 106 into the loops. The strap element 104 can, for example, be rubber or plastic, have additional padding, or comprise multiple pieces.

The body element 102 has several openings or holes 108. The holes 108 can be created in any desired shape, including, but not limited to, circles, squares, and triangles. The holes 108 can be created in a variety of sizes, for example, about 1-2 cm in diameter. The holes 108 can be positioned all around the body element 102, in a set order or in a random order, and are not limited by their positioning on the body element 102. In some embodiment, the holes 108 can be set as diametrically opposed pairs, thereby allowing a dental instrument to be inserted through the center of the handgrip 100. The holes 108 can then be positioned at opposite ends of the body element 102.

Each hole 108 is configured for a dental device such as, but not limited to, a toothbrush 110 to be inserted in a hole 108 through the body element 102 and through the interior volume of the body element 102, having a substantially similar shape to the body element 102. The hole 108 is configured so the toothbrush 110 is confined within the handgrip 100. The holes 108 can be configured to frictionally confine the toothbrush 110 in the body element 102. FIG. 1 illustrates an example wherein the toothbrush 110 inserts through one hole 108 in the body element 102 and exits another hole 108 in the body element 102. In some embodiments, the toothbrush 110 does not exit the handgrip 100 at the end opposite the brush, and may stay contained within the body element 102. In some embodiments, the holes 108 may be on exact opposite sides of the body element 102. In other embodiments, the holes 108 can be located in a random orientation around the body 102.

The toothbrush 110 can be moved in the longitudinal axis of the toothbrush 110 to adjust the positioning of the toothbrush 110 for teeth cleaning. The mobility allows a user to reach teeth farther back in their mouth. The handgrip 100 can be kept at the same distance from the mouth but different teeth can be reached by moving the toothbrush 110 in or out of the body element 102 in the axial direction of the toothbrush 110.

The toothbrush 110 can also be rotated around its longitudinal axis within the body element 102. This movement allows for a user to aim a dental device at different locations and angles within their mouth. Having the toothbrush 110 limited to one position would force user to change their wrist position to able to change the angle of the toothbrush 110, which may be difficult for some users. The handgrip 100 allows user with limited wrist strength, mobility, or dexterity to be able to brush their teeth at the appropriate positions. If the toothbrush 110 could be moved within the body element 102, a user may not be able to brush all of their teeth and therefore not be able to provide themselves adequate dental care.

The several openings or holes 108 also allows for the toothbrush 110 to be removed from the handgrip 100 and re-inserted into the handgrip 100 in another position. FIG. 1 illustrates examples of possible positions the toothbrush 110. The openings or holes 108 allows for the toothbrush 110 to be inserted into the handgrip 100 at a range of angles. The handgrip 100 allows for the toothbrush 110 to be inserted not just in the vertical axis, as shown by the thumb of the hand 106, but also at angles of approximately 45°, 90° and 135°. The openings or holes 108 in the handgrip 100 allows for the toothbrush to be inserted in angles in 360°, providing for any angle desired by a user. Additionally, the handgrip 100 can be rotated in a user's hand 106 so that the toothbrush 110 can be aligned in any desired angle. If the toothbrush 110 was limited to certain angles in the handgrip 100, a user would need to twist or change positions of their wrist to be able adjust the positioning of the toothbrush 110. The handgrip 100 allows a user to be able to clean all of their teeth without having to change wrist positioning by moving the location of the toothbrush 110 within the handgrip 100. A user would not be required to have wrist strength, mobility, or dexterity to be able to brush their teeth.

In some embodiments of the handgrip 100, the toothbrush 110 is held frictionally in place through the body element 102 in the holes 108. In some embodiments, the holes 108 are made of a compressive material, such as, for example, rubber. The holes 108 are configured to be tight enough that when a toothbrush 110 is pressed through them into the body element 110, they would provide enough force so that dental care could be provided without disturbing the position of the toothbrush 110. Because the toothbrush 110 is secured only be the holes 102, certain embodiments of the handgrip do not require other processes, such as springs or compressors or clasps or hooks, to hold the toothbrush in place 110. These other processes may be difficult for a user to operate. Also, the ability to frictionally hold the toothbrush 110 or other devices in place allows for a variety of different sized devices to be secured in the handgrip 100. The compressive material in the holes 108 can hold a small, thin device with frictional support but also can be opened up by inserting a larger dental device into the holes 108.

In certain embodiments of the handgrip, the body element is made of a material that can be slightly compressed. By having a slightly compressible material, a user would have a better overall feel for the handgrip. A handgrip with a hard or extremely rigid surface would not allow a user to control how hard they were on the toothbrush or other dental device onto the teeth. If a user was pressing too hard on the teeth, they could actually damage the enamel of the teeth or cause bleeding in the gums. The slight compressibility would also allow a user to control how hard they are pressing to brush their teeth without hurting them. The person could press as hard as they wanted, but the compressibility of the handgrip would keep the toothbrush from pressing too hard. While certain embodiments of the handgrip are not hard or rigid, embodiments are not too soft or too compressible. If the handgrip was too soft, a user may not be able to adequately clean their teeth. Therefore, the handgrip can be compressible enough so that it won't hurt a user's teeth, but not too compressible that the user would not be able to adequately provide dental care.

Figure 2:
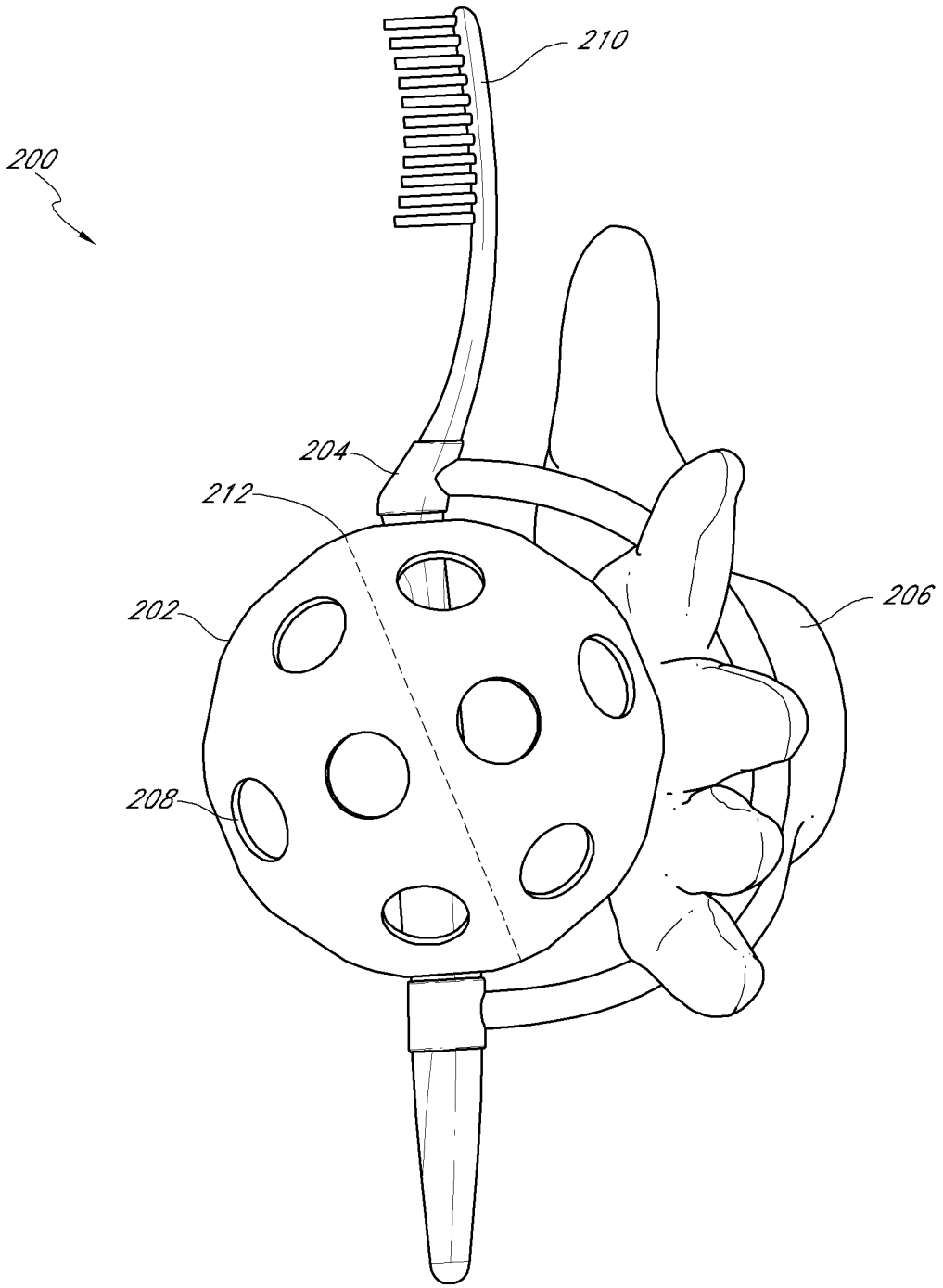
FIG. 2 illustrates another embodiment of a handgrip including a strap attached to a dental device.

FIG. 2 illustrates another embodiment that includes a handgrip and a strap element. The handgrip 200 is made up of a body element 202 and a strap element 204 that attaches the body element 202 to a hand 206. The body element 202 contains several openings or holes 208 spread throughout the body element 202, wherein a toothbrush or other dental device 210 can be placed through the holes 208 into the body element 202.

In some embodiments, the body element 202 is initially manufactured into two separate pieces. The handgrip 200 can be assembled, for example, at dotted line 212, by methods such as, but not limited to, gluing two halves of the handgrip together, welding two halves of the handgrip together, ultrasonic welding two halves of the handgrip together, melting two halves of the handgrip together, or screwing two halves of the handgrip together.

In the embodiment shown in FIG. 2, the strap element 204 is attached to the toothbrush 210 and wraps around the hand 206. The strap element 204 can be made out of, for example, a compressible material with a loop at the ends that allows the toothbrush 210 to be pressed through the strap element 204 and held in place. The strap element 204 can be tightened around the ends of the toothbrush 210 once the toothbrush 210 is inserted through the strap element 204. The some embodiments, the strap element 204 comprises symmetrical ends. In some embodiments, the strap element 204 comprises different shapes at the ends.

By having the strap element 204 attach directly to the toothbrush 210, the toothbrush 210 can be inserted at different heights within the body element 202, without needing frictional holding within the holes 208 of the body element 202. The strap elements 204 can attach to the toothbrush 210 and be wide enough not to insert through the holes 208 in the body element 202. Therefore, the strap element 204 ends placed directly on the outside of the body element 202 would keep the toothbrush 210 securely in position. Additionally, the holes 208 can be made large enough to hold many different types of dental devices, as the strap element 204 can be wrapped around the device to keep it in place within the body 202. The embodiment shown in FIG. 2 may not use frictional compressible material in the holes 208 to secure the toothbrush 210. The toothbrush 210 can still be moved in or out in its longitudinal axis or spun around its longitudinal axis within the strap element 204, as mentioned above, to allow a user to reach farther-back teeth or to turn the toothbrush 210 to reach different sides of the teeth while brushing or providing other dental care.

Figure 3:
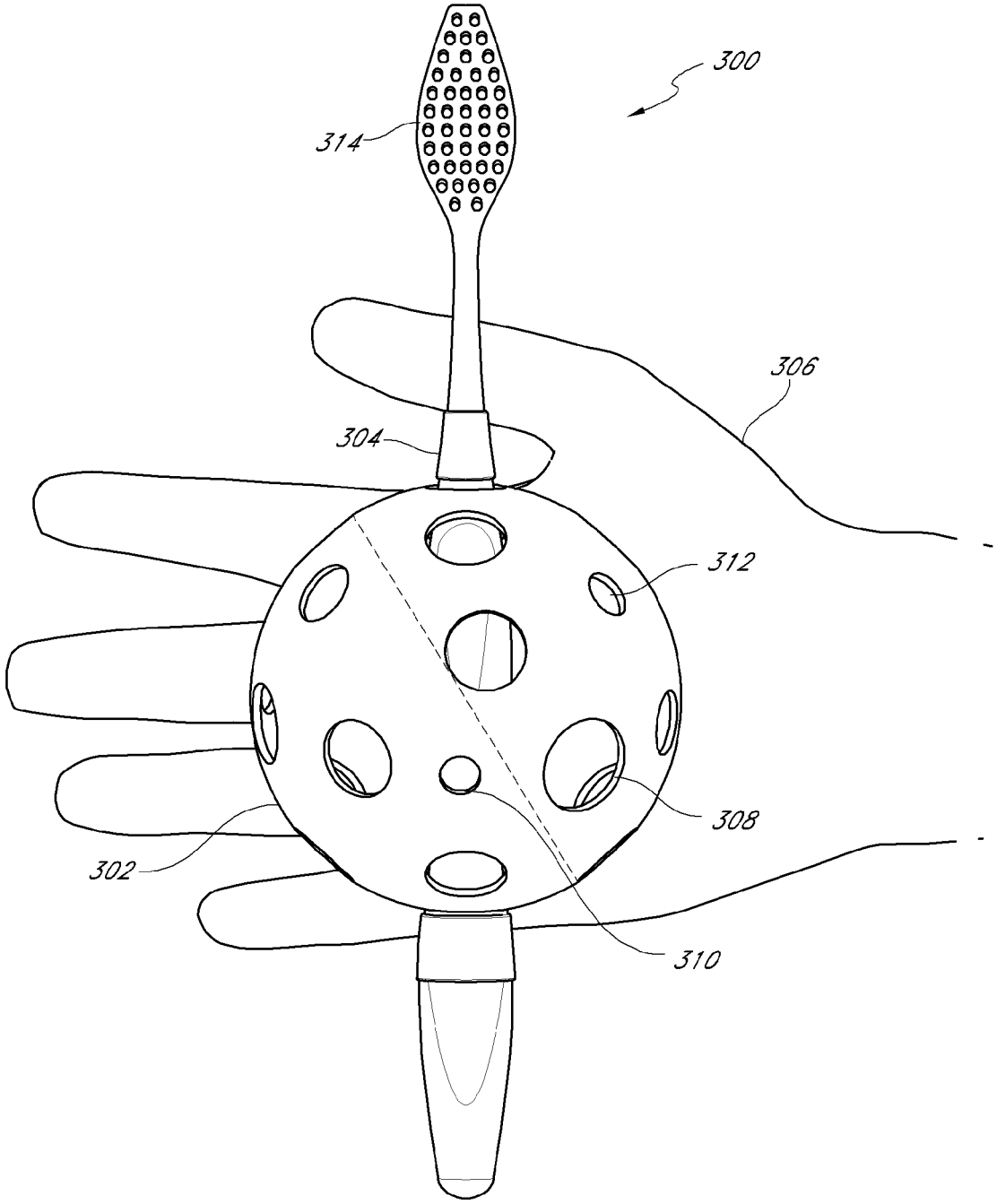
FIG. 3 illustrates another embodiment of a handgrip where a handgrip includes different-sized holes to accommodate different sized dental instruments.

FIG. 3 illustrates another embodiment of a handgrip with a strap element. The handgrip 300 contains a body element 302 and a strap element 304 that attaches the body element 302 to a hand 306. The handgrip contains several openings or holes 308 throughout the body element 302.

In this embodiment, the plurality of holes is manufactured into different sizes within the handgrip 300. The plurality of holes can include large holes 308, small holes 310 and medium-sized holes 312. The holes can have a range of diameters such as 0.5 cm to 5 cm. The size of the holes is not limiting and the holes can be formed in any desired size. In some embodiments, substantially similar sized holes are opposite one another in the body element 302. In other embodiments, the holes are randomly placed within the body element 302. The plurality of different sized holes can be configured to hold a toothbrush 314 or other dental device, depending on the size of the device. The strap element 304 can either be wrapped around the toothbrush 314 or other dental device, or can be attached onto the body element 302. As mentioned above, the toothbrush 314 or other dental device can be pulled in and out in the longitudinal axis as well as rotated around the longitudinal axis.

The plurality of sizes of the holes 308, 310 and 312 allows for a variety of different-sized dental devices to be inserted into the body element 302. As the dental elements can be inserted and held using frictional resistance, this embodiment can diminish the force used to insert a dental device into the body element 302. The holes need only to be able to expand to the next larger sized hole, and not necessarily to the size of the dental device. Therefore, hole 310 needs only be able to expand to the size of hole 312 and hole 312 needs only be able to expand to the size of hole 308. This embodiment of a handgrip can reduce the force to insert a larger dental device into the holes, as the handgrip 300 will contain a hole more suitable to the specific dental device. Some users may lack the strength to force a large dental device into a smaller hole with compressive material.

Attachment of Strap Elements

Certain embodiments include one of a variety of strap elements. Strap element is a broad term and is to be given its ordinary and customary meaning to a person of ordinary skill in the art (that is, it is not to be limited to a special or customized meaning) and includes, without limitation, a supporting band. Strap elements can be made from many different materials such as, but not limited to, plastic, cloth, and rubber. The strap element can both attach directly to the body element of the handgrip as well as attach directly to the dental device inserted into the hand grip. The strap element can attach to an attachment element coupled to the body of the handgrip. The attachment element can comprise, for example, a prong or a slot. In some embodiments, the attachment element can be integrally formed with the body element. However, the handgrip does not require a strap element. Some users may not need to use the strap element in order to properly provide themselves with adequate dental care.

Figure 4:
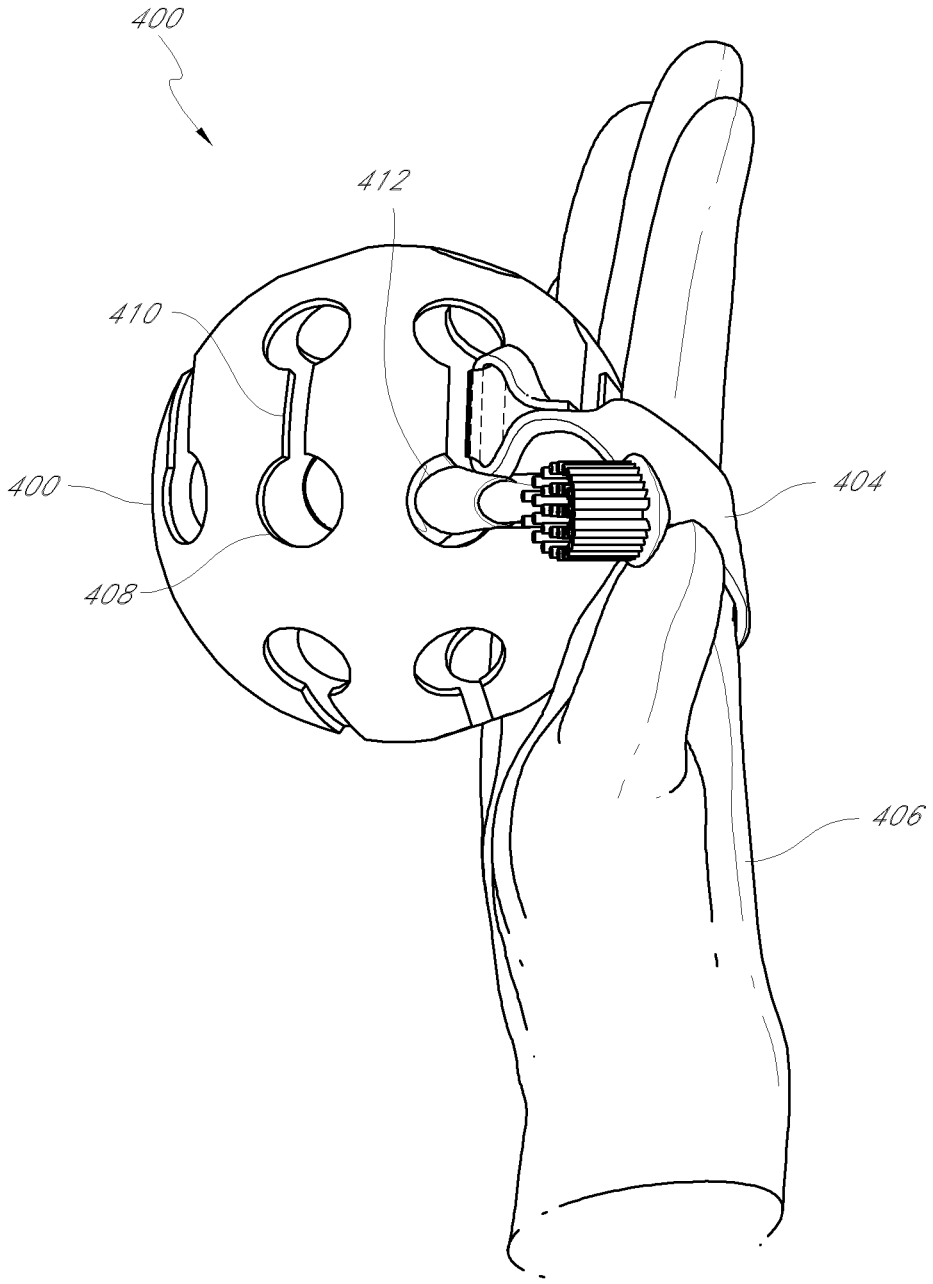
FIG. 4 illustrates another embodiment of a handgrip where a strap is secured with a tab formed by adjacent holes.

FIG. 4 illustrates one embodiment of a handgrip where the strap element of the handgrip is attached directly onto the body element of the handgrip. The handgrip 400 contains a body element 402 and a strap element 404 that connects the body element 402 to a hand 406. The body element 402 contains several openings or holes 408. Instead of the holes 408 being individual and isolated, as mentioned in some of the previous embodiments of the handgrip, the holes 408 are connected by a tab element 410. The tab element 410 can also be a stub, flap, or tag and is not limited by the language "tab element." A toothbrush 412 can be inserted through the hole 408 without interfering with the tab element 410. As mentioned above, the hole 408 can be formed of a compressible material to secure the toothbrush 412 with frictional force. The tab elements 410 do not significantly deform the holes 408 so that the toothbrush 412 will still fit securely within the body element 402. The tab elements 410 may be made of the same elements as the body element 402, the same element as the compressible material that surrounds the holes 408 in some embodiments, or may be made of another material entirely.

The tab element 410 is formed to allow a strap element 404 to attach to the tab element 410, and thereby attaching the strap element 404 to the body element 402. The strap element 404 can have, for example, a loop, hole, or lasso, among others, at the ends which can be wrapped around the tab element 410, thereby securing the strap element 404 directly to the body element 402. Once the strap element 404 is securely attached to the body element 402, a user's hand 406 can be inserted between the body element 402 and the strap element 404, thereby allowing the handgrip 400 to sit comfortably within the palm of the user's hand 406.

In some embodiments, attaching the strap element 404 directly to the body element 402 allows for dental devices, for example, a toothbrush 412, to be removed from the body element 402, and a new dental device to be inserted into the holes 408 without having to remove the strap element 402 from the body element 402. Therefore, this embodiment does not require a step of removing the strap element 404 from a dental device to change dental devices. A user's hand 406 can stay attached to the body element 402 during the entire procedure. This allows for one less step in the process that requires some dexterity or strength.

The tab elements 410 can be made in a plurality of sizes. For example, in some embodiments, the holes 408 can be spaced close together, which would create a thin tab element 410. This embodiment would allow for the easier attachment of the strap element 402 as the strap element 402 would only need to loop around a small tab element 410. In some embodiments, the holes 408 can be spaced farther apart, which allows for a thick tab element 410. Having a thick tab element 410 would allow for more tension to be placed on the tab 410 without the possibility of breakage. The tab elements 410 can all be aligned to be parallel with each other throughout the body element 402 or can be randomized throughout the body element 402. If the tab elements 410 were all parallel to one another, a user would always know what position the handgrip 400 would need to be in to attach to a hand 406. However, randomized tab element 410 positions allows for a user to be able to choose the angle of the dental device inserted into the handgrip 400.

Figure 5:
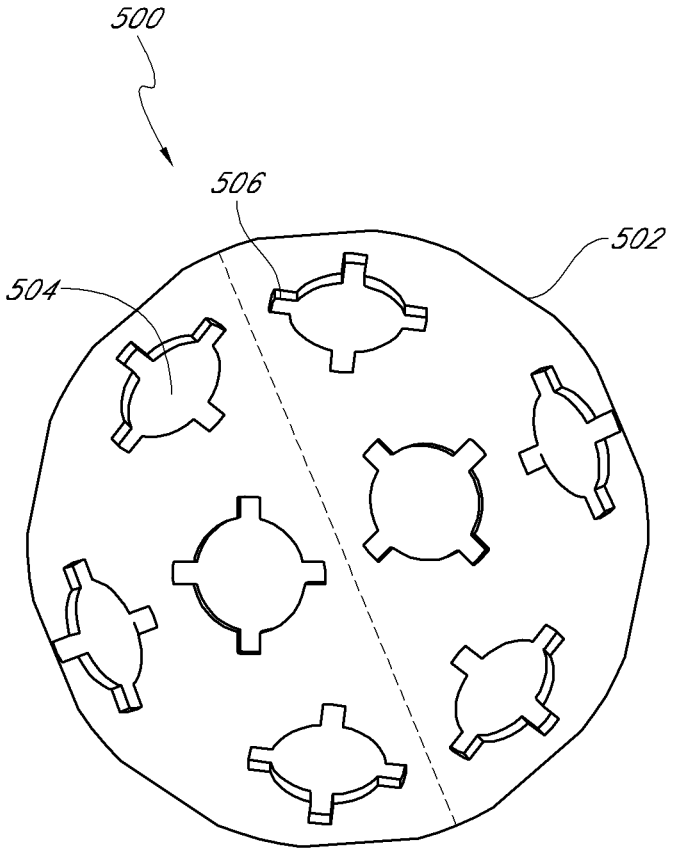
FIG. 5 illustrates another embodiment of a handgrip where a strap (not shown) may be secured to the handgrip with cutouts on the sides of the holes.

FIG. 5 illustrates another embodiment where strap elements can be attached to the body element of the handgrip prior to insertion of a dental instrument. In this embodiment, the handgrip 500 contains a body element 502 with openings or holes 504. The holes 504 contain small cut-out elements 506 (sometimes referred to as slots, channels, or openings). These cut-out elements 506 can comprise different shapes, such as, for example, rectangles or semi-circles. The cut-outs 506 can be manufactured during molding or can be formed during a post molding process. The cut-out elements 506 surrounding the holes 504 can vary in number, such as, but not limited to two cut-outs, three cut-outs, four cut-outs, and five cut-outs. The cut-out elements 506 can be oriented in random directions throughout the body element 502, or can all be aligned in the same direction.

A strap element having an enlarged end (not shown in FIG. 5), can be inserted into the holes 504 wherein the strap element can be pulled or maneuvered so that the enlarged end strap element lodges beneath the body element 502 within the cut-out elements 506. The strap element can be secured into the body element 502 by, for example, a knot at the end of the strap element, which would keep the strap element attached to the body element 502. This embodiment allows for ease of attaching the strap element into the body element 502. A user inserts a strap element into the hole 504, wherein once the strap element is pulled tight, the end of the strap element may slide into one of the cut-out elements 506, allowing the strap element to stay securely within the body element 502. The handgrip 500 could then be able to be attached to a hand with little difficulty. This embodiment may provide useful for a user who lacks the hand dexterity to loop the end of a strap element around a tab.

Figure 6:
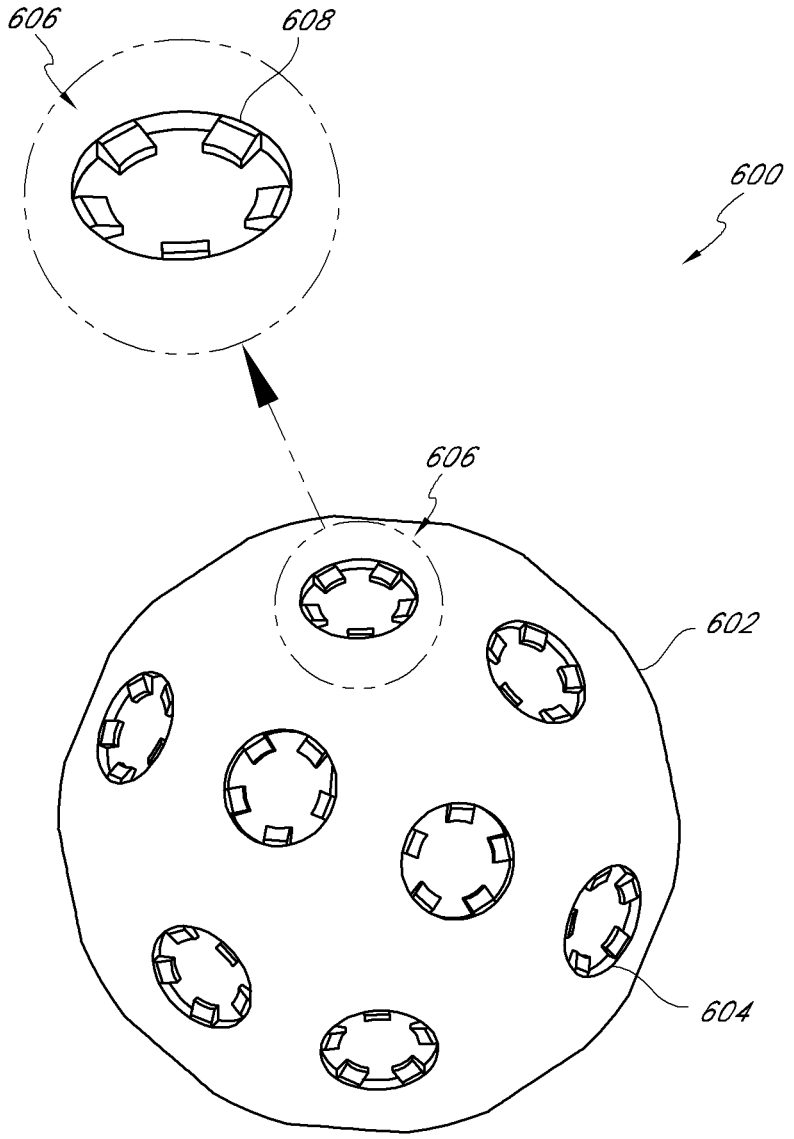
FIG. 6 illustrates another embodiment of a handgrip where a strap (not shown) may be secured to the handgrip using tabs formed within the handgrip holes.

FIG. 6 illustrates another embodiment of a handgrip where strap elements can be attached to the handgrips body element. FIG. 6 also illustrates a magnified image of holes within the body element. In this embodiment, the handgrip 600 contains a body element 602 with holes 604. Each hole 604, as shown in the magnification 606, contains a plurality of tab elements 608 protruding into the center of the hole 604. The tab elements 608 can be formed into rectangular protrusions from the body element 602 into the holes 604. In some embodiments, the tab elements 608 are sloped on one side. In other embodiments, the tab elements form a triangle protruding from the body element 602 towards the center of the hole element 604. In other embodiments, the tab elements 608 protrude from the body element 602 into the holes 604 approximately 5 mm. The design of the tab element 608 is non-limiting and numerous types of designs can be used.

Figure 8:
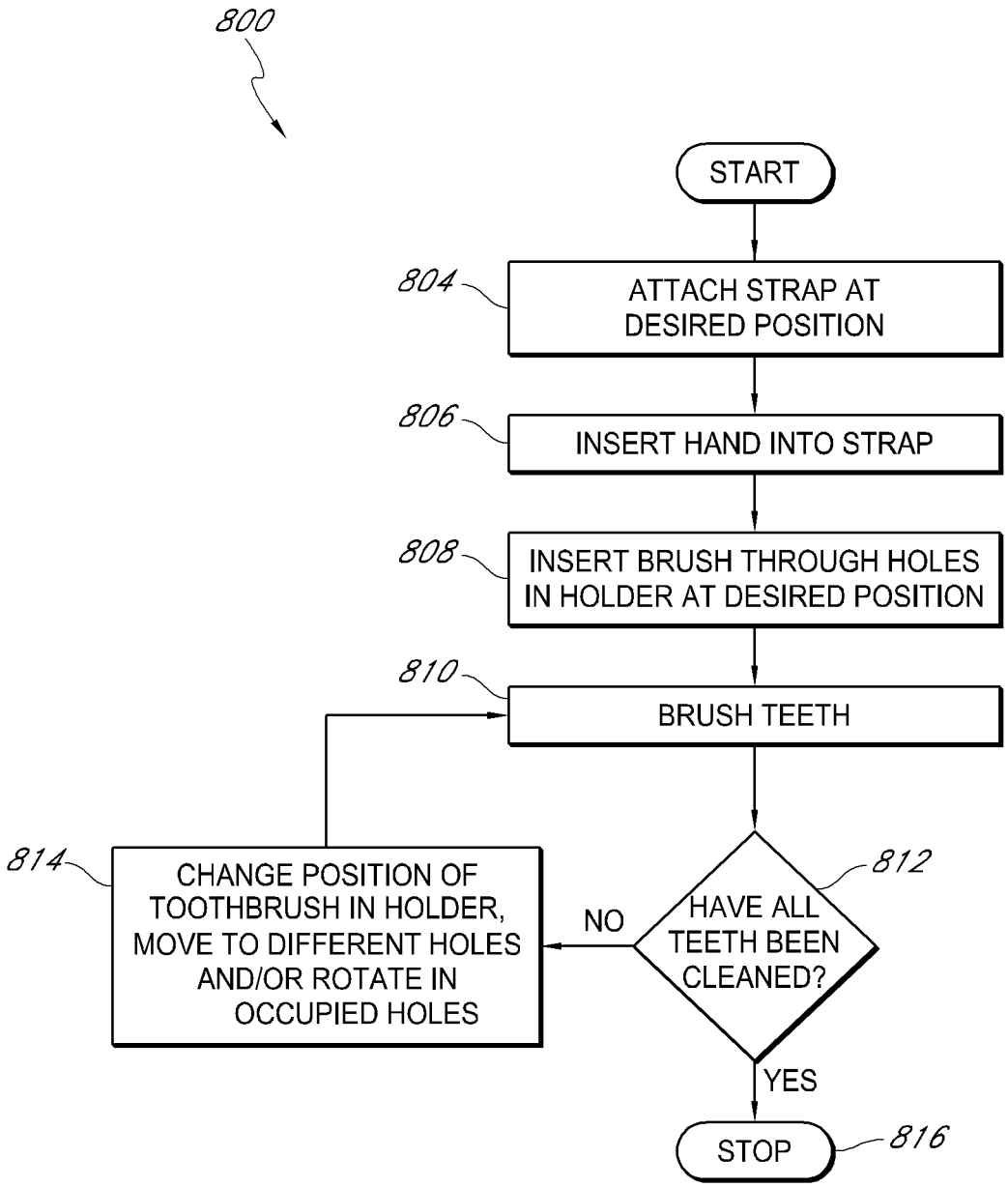
FIG. 8 illustrates a flow chart for using the handgrip to provide handgrip-assisted dental care.

In the embodiment shown in FIG. 8, the tab elements 608 have multiple possible functions within the body element 602. Certain embodiments of the handgrip 600 have tab elements 608 that are made of flexible or compressible material so that when a toothbrush or other dental device is inserted through the hole 604, the tab elements 608 help to frictionally contain the dental device within the body element 602. The tab elements 608 can also be used to hold a strap element into the body element 602. A strap with, for example, a circle, loop, or hole at the end can be wrapped around one of the tab elements 608. This allows for the strap to be attached directly to the body element 602 and keep the handgrip 600 attached to a hand. The hole 604 can contain plurality of tab elements 608, for example, but not limited to, two, three, four, five or six tab elements 608 within each hole 604. These numerous tab elements 608 allow for ease of positioning of the body element 602 so that a strap can be attached in many different directions of the body element 602. Therefore, the body element 602 and strap element do not have to be perfectly aligned.

Ends of Strap Elements

The strap element generally comprises an elongate, tubular (e.g., band, cord, etc.) or planar length (e.g., belt, strap, etc.) of material having a proximal and distal or first and second ends. The ends are formed to best attach the strap element to the body of the handgrip, while keeping a hand comfortably secured to the handgrip. The strap element can be made of many different materials and sizes. The strap element may have additional thicker material added in the middle so that the tension in the strap element is spread across a larger area on the hand. The strap element may comprise holes for fingers to be inserted into.

Figure 7:
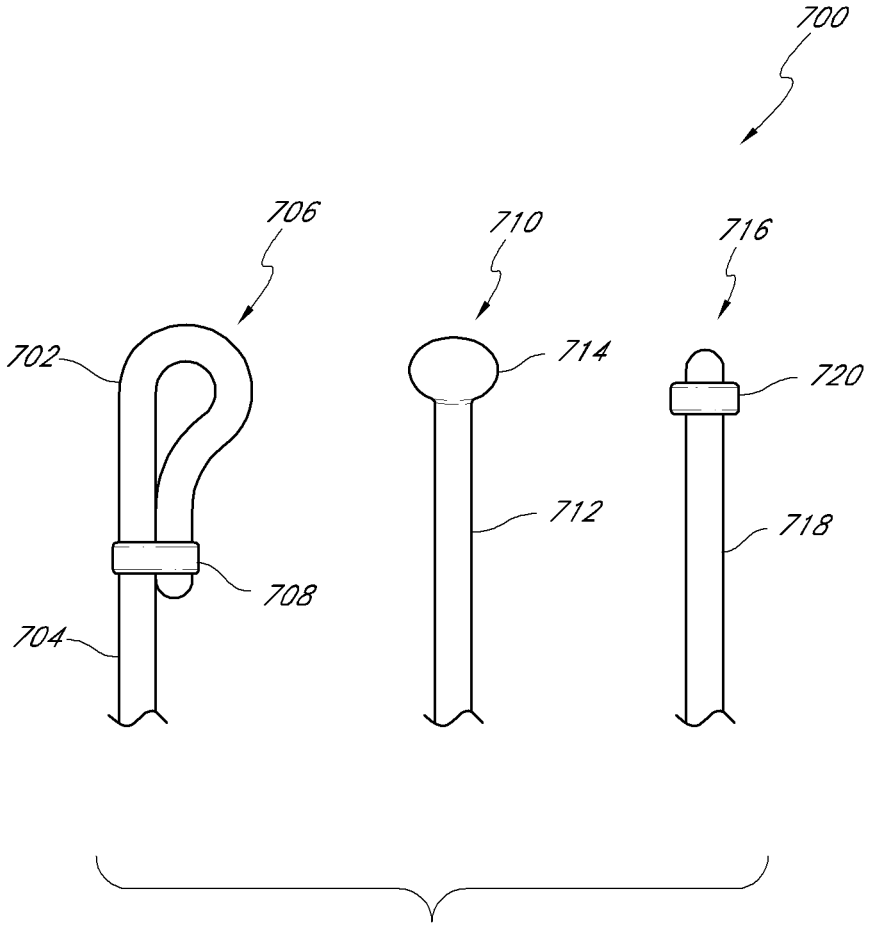
FIG. 7 illustrates embodiments of strap ends that can be used to secure a strap to one of the handgrips of FIGS. 1-6.

FIG. 7 illustrates the ends of examples of a strap element that can be used in the handgrip. In one embodiment 702, the strap element includes a flexible material, such as, but not limited to, a plastic or a cloth. The strap element can be looped at the end to form a loop or a lasso 706. The lasso 706 can be used to wrap around one of the tab elements from above mentioned embodiments of a handgrip, and can also be inserted into the holes of an above mentioned embodiment of a handgrip so that the loop catches on the inside of cut-out elements to secure it. This loop 706 can also be used to attach to other numerous embodiments of the handgrip.

In another embodiment 710, the strap element includes a flexible material, such as, but not limited to, a plastic or a cloth. The strap has a length 712 which, at the end, comes to a bulbous head element 714. This head element 714 can be, for example, a thicker piece of the material 712 or be a knot tied at the end of piece 712. The head element 714 could also be another material attached to the length 712 to form a larger head. The head element 714 could be attached with glue, crimping, or other non-limiting means. The head element 714 has a larger diameter than the length 712 and thus can be inserted into the body element of certain embodiments of the handgrip so that the head element 714 secures into the body element of the handgrip and does not come free. The head element 714 may also be made of a material with higher friction, so it will prevent the strap element 710 from slipping outside of the body element of the handgrip.

In another embodiment 710, the strap element a flexible material, such as, but not limited to, a plastic or a cloth. The strap has a length 718 which, at the ends, contains a crimp 720. This crimp 720 can be formed from a variety of materials such as, but not limited to, metal or plastic. The crimp 720 has a larger diameter than the length 718, and thus can be inserted into the body element of certain embodiments of the handgrip so that the crimp 720 secures into the body element of the handgrip and does not come free. The crimp element 720 may also be made of a material with higher friction, so it can prevent the strap element 716 from slipping outside of the body element of the handgrip.

Method

Certain embodiments of this handgrip provide useful a user who lacks the hand grip or dexterity or mobility to allow them to adequately provide themselves with dental care. The method of using embodiments of the handgrip can utilize, for example, dental devices such as, but not limited to, toothbrushes for brushing teeth, rubber-tipped dental picks for cleaning between teeth to remove plaque or other build-ups that a toothbrush may or may not be able to remove, and flossing devices to floss in between teeth and remove items imbedded in the gums. Other types of dental devices can also be inserted into the handgrip. FIG. 8 illustrates one example of brushing teeth using embodiments of the handgrip. However, this method can also be used with other dental devices. First, the user decides to begin the steps of brushing their teeth. Next, the user attaches the strap element to either the dental device at the desired position 804. The user then inserts their hand 806 in between the strap element and the body element of the handgrip. In some embodiments, steps 804 and 806 may be unnecessary. Next, the user inserts a toothbrush through the holes in the holder at a desired position 808.

The user begins to brush their teeth 810. After brushing all possible teeth with the current orientation of the toothbrush in the handgrip, the user asks themselves 812, "are my teeth clean?" If the user does not think so, they can change the position of the toothbrush in the holder 814. This can be done by moving the toothbrush to a different hole and/or rotating the toothbrush in the occupied holes. The user can adjust the strap to move the handgrip into a different position in their hand. Any of these steps can be done, along with other possible steps, to provide the easiest dental care for the user. Once the toothbrush is moved to a different position within the holder, the user can then begin to brush their teeth once again 810. After brushing all possible teeth with the current orientation of the toothbrush in the handgrip, the user again asks themselves 812, "are my teeth clean?" If not, they repeat the same process 814 of changing position of the toothbrush or any other method to change the angles in the handgrip and then brush more teeth again. Once they have adequately brushed all of their teeth, the user can stop 816 brushing their teeth and remove the handgrip from their hand. These steps can be repeated for other dental procedures, such as flossing.

Provided herein are various non-limiting examples of a handgrip and a method of using a handgrip to provide adequate dental care to an elderly or special needs person. While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all the features and benefits as set forth herein, as some features may be used or practiced separate from others.

What is claimed is:

1. A dental device holder configured to adjustably retain a dental device in a user's hand comprising:

a substantially spherical outer wall having a substantially uniform outer wall thickness;

the wall defining a substantially spherical interior volume;

the wall having a plurality of substantially circular opening pairs diametrically opposed to each other and positioned at substantially opposite regions of the interior volume, each opening having a diameter of less than about 2 cm;

wherein each opening is sized to receive at least a portion of a dental device having an elongate shaft longer than a diameter of the substantially spherical interior volume, such that the elongate shaft enters the outer wall through a first opening of an opening pair, traverses the interior volume and exits the outer wall through a second opening of the opening pair;

wherein each opening pair is configured to frictionally retain the dental device within the wall during use;

wherein the wall further comprises a slot that extends between two adjacent openings of the plurality of openings;

wherein the slot and wall together define an attachment portion.

2. An elongate device holding system configured to adjustably retain an elongate device in a user's hand comprising in combination:

an elongate device, comprising an elongate shaft;

an elongate device holder adapted to hold the elongate device, the elongate device holder comprising:

an outer wall having a substantially uniform outer wall thickness;

the wall defining an interior volume;

the wall having a plurality of openings distributed about the outer wall;

wherein each opening is sized to receive at least a portion of the elongate device; and wherein the elongate shaft enters the outer wall through a first opening, traverses the interior volume and exits the outer wall through a second opening; and a strap, wherein a first portion of the strap is coupled to a first portion of the elongate shaft located near the first opening and a second portion of the strap is coupled to a second portion of the elongate shaft located near the second opening.

3. The elongate device holding system of claim 2, further comprising an attachment element coupled to the outer wall.

4. The elongate device holding system of claim 3, wherein the attachment element comprises a prong.

5. The elongate device holding system of claim 3, wherein the attachment element is integrally formed with the outer wall.

6. The elongate device holding system of claim 3, wherein the attachment element comprises a slot located on the outer wall, said slot and said wall together defining an attachment portion.

7. The elongate device holding system of claim 6, wherein the slot extends from one opening to an adjacent opening.

8. The elongate device holding system of claim 2, wherein the elongate device comprises a toothbrush.

9. The elongate device holding system of claim 2, wherein the outer wall comprises a compressible material.

10. The elongate device holding system of claim 2, wherein the outer wall comprises a smooth surface.

11. The elongate device holding system of claim 2, wherein an orientation of the elongate device within the elongate device holder is adjustable without moving or manipulating the elongate device holder.

12. The elongate device holding system of claim 11, wherein the openings are configured to allow for rotation of the elongate device in the elongate device holder.

13. The elongate device holding system of claim 11, wherein the openings are configured to allow for translation of the elongate device with respect to the elongate device holder, wherein the elongate shaft remains within the outer wall during translation.

14. The elongate device holding system of claim 2, wherein the outer wall comprises a single piece.

15. The elongate device holding system of claim 2, wherein the plurality of openings comprises a plurality of sizes.

16. A method of providing an elongate device holding system, configured to adjustably retain an elongate a device in a user's hand comprising in combination:

providing an elongate device, comprising an elongate shaft;

providing an elongate device holder adapted to hold the elongate device, the elongate device holder comprising:

a substantially spherical outer wall having a substantially uniform outer wall thickness, the wall defining a substantially spherical interior volume, the wall having a plurality of openings distributed about the outer wall, wherein each opening is sized to receive at least a portion of the elongate device;

inserting the elongate device through a first opening of the elongate device holder, such that the elongate device extends through the elongate device holder and exits the elongate device holder through a second opening; providing a strap;

securing a first portion of the strap to a first portion of the elongate shaft located near the first opening; and securing a second portion of the strap to a second portion of the elongate shaft located near the second opening.

17. The method of providing an elongate device holding system of claim 16, wherein the elongate device comprises a toothbrush.

18. The method of providing an elongate device holding system of claim 16, wherein the outer wall comprises a compressible material.

19. The method of providing an elongate device holding system of claim 16, further comprising changing the orientation of the elongate device within the elongate device holder by removing the elongate device from the elongate device holder and inserting the elongate device into a third opening of the elongate device holder, such that the elongate device extends through the elongate device holder and exits the elongate device holder through a fourth opening.

20. The method of providing an elongate device holding system of claim 16, further comprising changing the orientation of the elongate device within the elongate device holder by rotating the elongate device within the elongate device holder.

* * * * *

UNITED STATES PATENT AND TRADEMARK OFFICE

CERTIFICATE OF CORRECTION

PATENT NO. : 9,044,853 B2
APPLICATION NO. : 13/799738
DATED : June 2, 2015
INVENTOR(S) : Phui It is certified that error appears in the above-identified patent and that said Letters Patent is hereby corrected as shown below:

In the claims

Column 14 line 11, Claim 16, change “elongate a device” to --elongate device--.

Signed and Sealed this
Ninth Day of February, 2016

Michelle K. Lee

Michelle K. Lee
*Director of the United States Patent and Trademark Office*